US011232878B2

(12) United States Patent
Kazama et al.

(10) Patent No.: US 11,232,878 B2
(45) Date of Patent: Jan. 25, 2022

(54) CHEMICAL DECONTAMINATION METHOD

(71) Applicants: KURITA ENGINEERING CO., LTD., Osaka (JP); HITACHI-GE NUCLEAR ENERGY, LTD., Hitachi (JP)

(72) Inventors: Masahiko Kazama, Osaka (JP); Naobumi Tsubokawa, Osaka (JP); Kazushige Ishida, Tokyo (JP); Satoshi Ouchi, Hitachi (JP); Junji Iwasa, Hitachi (JP)

(73) Assignees: KURITA WATER INDUSTRIES LTD., Tokyo (JP); HITACHI-GE NUCLEAR ENERGY, LTD., Hitachi (JP)

( * ) Notice: Subject to any disclaimer, the term of this patent is extended or adjusted under 35 U.S.C. 154(b) by 333 days.

(21) Appl. No.: 16/491,887

(22) PCT Filed: Mar. 1, 2018

(86) PCT No.: PCT/JP2018/007804

§ 371 (c)(1),
(2) Date: Sep. 6, 2019

(87) PCT Pub. No.: WO2018/163960

PCT Pub. Date: Sep. 13, 2018

(65) Prior Publication Data

US 2020/0013519 A1 Jan. 9, 2020

(30) Foreign Application Priority Data

Mar. 10, 2017 (JP) ..... JP2017-046403

(51) Int. Cl.
*G21F 9/00* (2006.01)
*G21F 9/12* (2006.01)

(52) U.S. Cl.
CPC ..... *G21F 9/004* (2013.01); *G21F 9/12* (2013.01)

(58) Field of Classification Search
CPC ..... G21F 9/00; G21F 9/004; G21F 9/12
USPC ..... 588/7
See application file for complete search history.

(56) References Cited

U.S. PATENT DOCUMENTS 9,230,699 B2 1/2016 Ishida et al.

FOREIGN PATENT DOCUMENTS

| | | | |
|---|---|---|---|
| JP | 2003-057393 | A | 2/2003 |
| JP | 4083607 | B2 | 4/2008 |
| JP | 4131814 | B2 | 8/2008 |
| JP | 2009-109427 | A | 5/2009 |
| JP | 2009-162687 | A | 7/2009 |
| JP | 2013-064696 | A | 4/2013 |
| JP | 2015-052512 | A | 3/2015 |
| JP | 2015-129642 | A | 7/2015 |
| JP | 2015-196857 | A | 11/2015 |

OTHER PUBLICATIONS

PCT/ISA/210,"International Search Report for International Application No. PCT/JP2018/007804," dated May 29, 2018.
Taiwan Patent Office, "Office Action for Taiwanese Patent Application No. 107107903," dated May 10, 2019.

*Primary Examiner* — Edward M Johnson
(74) *Attorney, Agent, or Firm* — Manabu Kanesaka

(57) ABSTRACT

A chemical decontamination method includes a dissolution step in which a radioactive insoluble substance containing a metal oxide, the radioactive insoluble substance being adhered to a decontamination object including carbon steel, is dissolved in a decontamination solution and a metal-ion removal step in which the decontamination solution containing the metal ion, the decontamination solution being produced in the dissolution step, is brought into contact with a cation-exchange resin in order to remove the metal ion, the dissolution step including a reductive dissolution step conducted using a decontamination solution containing formic acid, ascorbic acid and/or erythorbic acid, and a corrosion inhibitor.

9 Claims, No Drawings

CHEMICAL DECONTAMINATION METHOD

TECHNICAL FIELD

The present invention relates to a chemical decontamination method for decontaminating a decontamination object to which a radioactive insoluble substance (crud) is adhered in a nuclear power plant or the like.

BACKGROUND ART

Examples of the method for chemically decontaminating a decontamination object to which crud is adhered include the methods described in PTLs 1 to 3.

In PTL 1, a chemical decontamination method that includes a reductive dissolution step in which decontamination is performed using a reductive decontamination solution containing formic acid and oxalic acid and an oxidative dissolution step in which decontamination is performed using a decontamination solution containing an oxidizing agent is described. In PTL 2, a chemical decontamination method that includes a first step in which decontamination is performed using oxalic acid and a second step in which decontamination is performed using a reductive decontamination solution containing formic acid and oxalic acid is described. In PTL 3, a chemical decontamination method that includes a step in which decontamination is performed using a reductive decontamination solution containing formic acid and oxalic acid and a step in which metal ions contained in the decontamination solution are subsequently separated using a cation-exchange resin is described.

PTL 1: JP 4131814 B
PTL 2: JP 2009-109427 A
PTL 3: JP 4083607 B

In the decontamination of carbon steel, the amount of metal ions contained in a decontamination solution keeps increasing due to the corrosion of a base metal. Since the amount of iron ions that are to become dissolved in the decontamination solution is unpredictable, a large amount of cation-exchange resin needs to be used for purifying a decontamination waste solution.

When oxalic acid is used as a decontamination agent, a coating film composed of iron oxalate is formed on the surface of carbon steel. This coating film may inhibit the decontamination effects. The iron oxalate coating film remains on the surface of the carbon steel.

SUMMARY OF INVENTION

An object of the present invention is to provide a chemical decontamination method capable of purifying a decontamination waste solution with a small amount of cation-exchange resin and performing decontamination with efficiency.

The chemical decontamination method according to the present invention comprises dissolution step in which a radioactive insoluble substance containing a metal oxide, the radioactive insoluble substance being adhered to a decontamination object including carbon steel, is dissolved in a decontamination solution and a metal-ion removal step in which the decontamination solution containing the metal ion, the decontamination solution being produced in the dissolution step, is brought into contact with a cation-exchange resin in order to remove the metal ion, the dissolution step including a reductive dissolution step conducted using a decontamination solution containing formic acid, ascorbic acid and/or erythorbic acid (hereinafter, referred to as "ascorbic acid, etc."), and a corrosion inhibitor.

In one aspect of the present invention, the decontamination object includes carbon steel and stainless steel, and the dissolution step includes an oxidative dissolution step conducted using a decontamination solution containing permanganic acid and/or a permanganic acid salt (hereinafter, referred to as "permanganic acid (salt)") at a concentration of 100 to 2,000 mg/L, a reductive decomposition step in which a reducing agent is added to the decontamination solution treated in the oxidative dissolution step in order to perform reductive decomposition of the permanganic acid (salt), and the reductive dissolution step conducted subsequent to the reductive decomposition step.

In one aspect of the present invention, in the reductive decomposition step, ascorbic acid, etc. is added to the decontamination solution in an amount 1.0 to 2.0 times the amount equivalent to the permanganic acid (salt) in order to perform the reductive decomposition of the permanganic acid (salt).

In one aspect of the present invention, in the reductive dissolution step, the metal oxide is dissolved in a decontamination solution containing formic acid at a concentration of 1,000 to 10,000 mg/L, ascorbic acid, etc. at a concentration of 400 to 4,000 mg/L, and a corrosion inhibitor at a concentration of 100 to 500 mg/L.

In one aspect of the present invention, the metal-ion removal step includes a first cation-exchange treatment step in which the decontamination solution containing the metal ion, the decontamination solution being produced in the reductive dissolution step, is passed through a cation-exchange resin column in order to produce first cation-exchange treatment water containing an Fe ion at a concentration of 300 mg/L or less.

In one aspect of the present invention, subsequent to the first cation-exchange treatment step, a formic acid oxidative decomposition step in which a corrosion inhibitor is added to the first cation-exchange treatment water at a concentration of 200 to 300 mg/L and hydrogen peroxide is subsequently added to the first cation-exchange treatment water in an amount 1 to 3 times the amount equivalent to the formic acid in order to decompose the formic acid using the Fe ion as a catalyst is conducted.

In one aspect of the present invention, the metal-ion removal step includes a second cation-exchange treatment step in which water treated in the formic acid oxidative decomposition step is irradiated with ultraviolet radiation and subsequently passed through a cation-exchange resin column in order to remove the metal ion.

In one aspect of the present invention, an ascorbic acid, etc. oxidative decomposition step in which a corrosion inhibitor is added to water treated in the second cation-exchange treatment step at a concentration of 200 to 300 mg/L, hydrogen peroxide is subsequently added to the treated water, and the treated water is then irradiated with ultraviolet radiation in order to perform oxidative decomposition of the ascorbic acid, etc. is conducted.

In one aspect of the present invention, water treated in the ascorbic acid, etc. oxidative decomposition step is passed through a mixed-bed resin column in order to produce treated water having an electric conductivity of 2 μS/cm or less.

Advantageous Effects of Invention

In the chemical decontamination method according to the present invention, a corrosion inhibitor is used for reducing the corrosion of carbon steel. This limits an increase in the amount of metal ions contained in the decontamination solution due to the corrosion and results in reductions in the amount of cation-exchange resin used for purifying the metal ion-containing decontamination solution, that is, a decontamination waste solution, and the amount of wastes.

The decontamination solution used in the present invention contains formic acid, ascorbic acid, etc., and a corrosion inhibitor. This prevents formation of a coating film composed of iron oxalate or the like on the surface of carbon steel and increases the decontamination effects. Furthermore, the dissolving power of the decontamination solution is increased, which results in great decontamination efficiency.

DESCRIPTION OF EMBODIMENTS

In the chemical decontamination method according to the present invention, the decontamination object includes carbon steel to which a radioactive insoluble substance (crud) containing a metal oxide is adhered. Examples thereof include pipes, various devices, and structural members and soon included in radiation-handling facilities, such as a nuclear power plant. Examples of the decontamination object including carbon steel include a decontamination object composed only of carbon steel and a decontamination object composed of carbon steel and stainless steel.

The chemical decontamination method according to the present invention is divided into the following two types of decontamination steps depending on the type of the decontamination object.

(1) A Case where the Decontamination Object is Composed of Carbon Steel and Stainless Steel

[Oxidative dissolution step]→[Reductive decomposition step]→[Reductive dissolution step]→[First cation-exchange treatment step]→[Formic acid oxidative decomposition step]→[Second cation-exchange treatment step]→[Ascorbic acid, etc. oxidative decomposition step]→[Final Purifying Step using Mixed-bed]

(2) A case where the decontamination object is composed only of carbon steel

[Reductive dissolution step]→[First cation-exchange treatment step]→[Formic acid oxidative decomposition step]→[Second cation-exchange treatment step]→[Ascorbic acid, etc. oxidative decomposition step]→[Final purifying step using mixed-bed]

Although the oxidative dissolution step and the reductive decomposition step may be conducted prior to the reductive dissolution step even in the case where the decontamination object is composed only of carbon steel as in the case where the decontamination object is composed of carbon steel and stainless steel, it does not increase the advantageous effects. Therefore, in the case where the decontamination object is composed only of carbon steel, it is preferable to start with the reductive dissolution step.

For example, when the inner surface of a pipe or the like is decontaminated in the above-mentioned oxidative dissolution step or reductive dissolution step, it is preferable to pass a decontamination solution containing an oxidizing agent or reducing agent first through the pipe in a circulatory manner. Specifically, it is preferable to store the decontamination solution in a tank and pass the decontamination solution through the pipe or the like in a circulatory manner with a circulation pump. The reductive decomposition step is preferably conducted while the circulation of the decontamination solution is continued.

Details of each of the above steps are described below.

[Oxidative Dissolution Step]

The decontamination solution used in the oxidative dissolution step preferably contains, as an oxidizing agent, permanganic acid and/or a permanganic acid salt (hereinafter, referred to as "permanganic acid (salt)") at a concentration of 100 to 2,000 mg/L or, specifically, 200 to 500 mg/L.

Common examples of a permanganic acid salt include, but are not limited to, potassium permanganate.

The oxidizing agent-containing decontamination solution is preferably heated at 50° C. to 100° C. or, specifically, 80° C. to 90° C. and passed through a pipe in a circulatory manner for about 3 to 6 hours. The circulation of the oxidizing agent-containing decontamination solution causes oxidative dissolution of chromium included in the metal oxide contained in the crud.

[Reductive Decomposition Step]

Subsequent to the above-mentioned oxidative dissolution step, while the circulation of the above-mentioned oxidizing agent-containing decontamination solution is continued, a reducing agent is added to the oxidizing agent-containing decontamination solution in order to perform reductive decomposition of residual permanganic acid (salt). Ascorbic acid, etc. is suitable and ascorbic acid is particularly suitable as a reducing agent used for reducing the permanganic acid (salt). The amount of the ascorbic acid, etc. used is preferably 1.0 to 2.0 times and is particularly preferably 1.0 to 1.5 times the amount equivalent to the permanganic acid (salt) contained in the decontamination solution. The reductive decomposition of potassium permanganate, which is an example of the permanganic acid (salt), by ascorbic acid is represented by the following equation:

$$2\ KMnO_4 + 3\ C_6H_8O_6 \rightarrow 2\ MnO_2 + 2\ KOH + 2\ H_2O + 3\ C_6H_6O_6$$

The temperature of the decontamination solution at the time when the ascorbic acid, etc. is added to the oxidizing agent-containing decontamination solution is preferably 50° C. to 100° C. and is particularly preferably 80° C. to 90° C. While the decomposition of a permanganic acid (salt) by oxalic acid generates a carbonic acid gas, the decomposition of a permanganic acid (salt) by ascorbic acid, etc. does not generate a gas and eliminates the risk of cavitation in a circulation pump.

[Reductive Dissolution Step]

Subsequent to the above-mentioned step of reductive decomposition of the permanganic acid (salt), a reductive dissolution step in which, while the water treated by the reduction treatment is passed through a pipe or the like in a circulatory manner, formic acid, ascorbic acid, etc., and a corrosion inhibitor are added to the water treated by the reduction treatment in order to dissolve metal oxides with a decontamination solution containing formic acid, ascorbic acid, etc., and a corrosion inhibitor is conducted.

As described above, in the case where the decontamination object is composed only of carbon steel, the reductive dissolution step is conducted by passing a reducing agent-containing decontamination solution containing predetermined amounts of formic acid, ascorbic acid, etc., and a corrosion inhibitor through a pipe or the like in a circulatory manner.

The ascorbic acid, etc. is particularly preferably ascorbic acid. The corrosion inhibitor is preferably an organic corrosion inhibitor. For example, a corrosion inhibitor containing an imidazoline quaternary ammonium salt (imidazoline surfactant) and thiourea and/or alkylthiourea (e.g., a corrosion inhibitor containing 1 to 5 weight % thiourea and/or 1 to 5 weight % alkylthiourea and 1 to 5 weight % imidazoline quaternary ammonium salt (imidazoline surfactant)) is preferable. The contents of the above components in the decontamination solution or the amounts of the above components added to the decontamination solution are as follows.

Formic acid: 1,000 to 10,000 mg/L and, specifically, 2,500 to 5,000 mg/L

Ascorbic acid, etc.: 400 to 4,000 mg/L and, specifically, 1,000 to 2,000 mg/L

Corrosion inhibitor: 100 to 500 mg/L and, specifically, 200 to 300 mg/L

In this step, the water temperature is preferably 50° C. to 100° C. and is particularly preferably 80° C. to 90° C., and the amount of time during which the circulation of the decontamination solution is preferably about 6 to 24 hours. This step causes the metal oxides contained in the crud adhered to the decontamination object to be reduced and removed by dissolving.

[First Cation-Exchange Treatment Step]

The metal ion-containing decontamination solution produced in the above-mentioned reductive dissolution step is treated by cation exchange in order to cause Fe ions to be adsorbed to a cation-exchange resin and removed. In this first cation-exchange treatment step, the cation-exchange treatment is performed such that the concentration of Fe ions is preferably reduced to about 300 mg/L or less and is particularly preferably reduced to about 200 mg/L or less. This is because, when Fe ions remain in the water treated by the first cation-exchange, the residual Fe ions can be used as a catalyst in the subsequent step, that is, the formic acid oxidative decomposition step. In the case where the concentration of Fe ions is less than 100 mg/L in the first cation-exchange treatment step, it is preferable to add Fe ions (e.g., an Fe salt) to the water treated by the first cation-exchange before the subsequent step is started.

The first cation-exchange treatment step is preferably conducted by passing the water treated in the reductive dissolution step having a liquid temperature of 50° C. to 90° C. or, specifically, 80° C. to 90° C. through a cation-exchange resin column at an SV of 20 to 50 $hr^{-1}$.

[Formic Acid Oxidative Decomposition Step]

Subsequent to the above-mentioned first cation-exchange treatment step, oxidative decomposition of the formic acid contained in the water treated by the first cation-exchange is performed. Since the corrosion inhibitor is also removed in the first cation-exchange treatment step by being adsorbed to the cation-exchange resin, it is preferable to again add the same corrosion inhibitor as that used above to the water treated by the first cation-exchange at a concentration of about 200 to 300 mg/L in the formic acid oxidative decomposition step in order to suppress corrosion.

Subsequently, hydrogen peroxide is added to the water treated by the first cation-exchange in an amount 1 to 3 times or, preferably, 1 to 2 times the amount equivalent to the formic acid in order to perform oxidative decomposition of the formic acid using Fe ions as a catalyst, which is represented by the following equation:

$$HCOOH+H_2O_2 \rightarrow 2\ H_2O+CO_2$$

[Second Cation-Exchange Treatment Step]

After it has been confirmed, by the Fenton method or the like, that the hydrogen peroxide contained in the water treated in the above-mentioned formic acid oxidative decomposition step has been completely decomposed (e.g., the concentration of the residual hydrogen peroxide is 1.0 mg/L or less) and, preferably, the treated water has been passed through an UV column equipped with a low-pressure mercury lamp and irradiated with UV (ultraviolet radiation) in order to reduce an $Fe^{3+}$ ion to an $Fe^{2+}$ ion, the treated water is passed through a cation-exchange resin column in order to remove metal ions (in particular, Fe ions) such that the concentration of the metal ions is reduced to preferably less than 1 mg/L. In this step, the water temperature is preferably 90° C. or less, and the SV is preferably about 20 to 50 $hr^{-1}$.

[Ascorbic Acid, etc. Oxidative Decomposition Step]

Subsequent to the above-mentioned second cation-exchange treatment step, oxidative decomposition of the ascorbic acid, etc. contained in the water treated by the second cation-exchange is performed. Since the corrosion inhibitor is also removed by adsorption in the second cation-exchange treatment step, the same corrosion inhibitor as that used above is added to the water treated by the second cation-exchange at a concentration of about 200 to 300 mg/L in this ascorbic acid, etc. oxidative decomposition step. Subsequently, hydrogen peroxide is added to the water treated by the second cation-exchange in an amount 0.8 to 2.0 times or, for example, in an amount substantially equal to the amount equivalent to the ascorbic acid, etc. and the treated water is irradiated with UV in order to perform oxidative decomposition of the ascorbic acid, etc. into water and a carbon dioxide gas. This reaction is represented by the following equation:

$$C_6H_8O_6+10\ H_2O_2 \rightarrow 6\ CO_2+14\ H_2O$$

In this step, the water temperature is preferably 90° C. or less. The treated water produced by the above treatment has a TOC concentration of 2 mg/L or less.

[Reuse of Treated Water]

The treated water may be fed to the mixed-bed final purifying step described below or may be reused for preparing a decontamination solution.

It is preferable to fed the water treated in the ascorbic acid, etc. oxidative decomposition step to the following mixed-bed final purifying step after using the treated water in the cycles of the oxidative dissolution step to the ascorbic acid, etc. oxidative decomposition step (when the decontamination object is composed of carbon steel and stainless steel) or the reductive dissolution step to the ascorbic acid, etc. oxidative decomposition step (when the decontamination object is composed only of carbon steel) about 2 to 4 times.

[Mixed-Bed Final Purifying Step]

After it has been confirmed, by the Fenton method or the like, that hydrogen peroxide does not remain in the water treated in the above-mentioned ascorbic acid, etc. oxidative decomposition step (e.g., the concentration of hydrogen peroxide is 1.0 mg/L or less), the treated water is passed through a mixed-bed resin column preferably at an SV of 20 to 50 $hr^{-1}$ in order to remove cations and anions and to produce final treated water having an electric conductivity of 2 μS/cm or less.

EXAMPLES

Example 1

A system that included carbon steel pipes (STPG370) having a length of 10 m and an inside diameter of 150 A and stainless steel pipes (SUS304) having a system capacity of 800 L and an inside diameter of 25 A was subjected to the decontamination treatment in accordance with the method according to the present invention. The corrosion inhibitor used was "IBIT 30AR" produced by Asahi Chemical Co., Ltd.

Specifically, the following treatment was performed. First, as an oxidizing agent-containing decontamination solution, 0.5 $m^3$ of a 300 mg/L potassium permanganate solution having a water temperature of 90° C. was prepared. The solution was stored in a tank and passed through the pipes in a circulatory manner at 2 $m^3$/hr for 4 hours with a circulation pump (oxidative dissolution step).

While the circulation of the decontamination solution was continued, 1 equivalent of ascorbic acid (ascorbic acid: 502 mg/L relative to potassium permanganate: 300 mg/L) was added to the decontamination solution in order to perform reductive decomposition of the potassium permanganate (reductive decomposition step).

To the water treated by the reductive decomposition, formic acid: 3,500 mg/L, ascorbic acid: 1,500 mg/L, and corrosion inhibitor: 200 mg/L were added. Subsequently, the treated water was passed through the pipes in a circulatory manner at 90° C. and 2 $m^3$/hr for 6 hours in order to dissolve metal oxides (reductive dissolution step).

The decontamination waste solution (90° C.) discharged in the reductive dissolution step was passed through a cation-exchange resin column at an SV of 30 $hr^{-1}$ in order to remove Fe ions by adsorption until the Fe ion concentration was reduced to 200 mg/L (first cation-exchange treatment step).

A corrosion inhibitor was added to the water treated by the first cation-exchange at a concentration of 200 mg/L. Subsequently, hydrogen peroxide was added to the treated water at a concentration of 5250 mg/L (in an amount 2 times the amount equivalent to the formic acid) in order to decompose the formic acid using the Fe ions remaining in the water as a catalyst (formic acid oxidative decomposition step).

After it had been confirmed that the concentration of the hydrogen peroxide remaining in the water treated by the oxidative decomposition of formic acid was 1.0 mg/L or less, the treated water was passed through an UV column and irradiated with UV. Subsequently, the treated water was passed through a cation-exchange resin column at an SV of 30 $hr^{-1}$ in order to reduce the concentration of Fe ions to about 1 mg/L (second cation-exchange treatment step). In this step, the heater was turned off and the water temperature naturally decreased.

A corrosion inhibitor was added to the water treated by the second cation-exchange at a concentration of 200 mg/L. Subsequently, hydrogen peroxide was added to the treated water at a concentration of 175 mg/L (in an amount 1 time the amount equivalent to the ascorbic acid). The treated water was then passed through an UV column and irradiated with UV in order to decompose the ascorbic acid (ascorbic acid, etc. oxidative decomposition step). The treated water had a TOC concentration of 2 mg/L.

After the sequence of the above-mentioned steps had been repeated 3 times, it was confirmed by the Fenton method that the concentration of the hydrogen peroxide contained in the water treated by the oxidative decomposition of ascorbic acid had been reduced to 1.0 mg/L or less. Subsequently, the treated water was passed through a mixed-bed resin column at an SV of 30 $hr^{-1}$ (mixed-bed final purifying step). As a result, treated water having an electric conductivity of 2 μS/cm was produced.

Although the present invention has been described in detail with reference to particular embodiments, it is apparent to a person skilled in the art that various modifications can be made therein without departing from the spirit and scope of the present invention.

The present application is based on Japanese Patent Application No. 2017-046403 filed on Mar. 10, 2017, which is incorporated herein by reference in its entirety.

The invention claimed is:

1. A chemical decontamination method comprising a dissolution step in which a radioactive insoluble substance containing a metal oxide, the radioactive insoluble substance being adhered to a decontamination object including carbon steel, is dissolved in a decontamination solution and a metal-ion removal step in which the decontamination solution containing the metal ion, the decontamination solution being produced in the dissolution step, is brought into contact with a cation-exchange resin in order to remove the metal ion, the dissolution step including a reductive dissolution step conducted using a decontamination solution containing formic acid, ascorbic acid and/or erythorbic acid (hereinafter, referred to as "ascorbic acid, etc."), and a corrosion inhibitor.

2. The chemical decontamination method according to claim 1, wherein the decontamination object includes carbon steel and stainless steel, and wherein the dissolution step includes an oxidative dissolution step conducted using a decontamination solution containing permanganic acid and/or a permanganic acid salt (hereinafter, referred to as "permanganic acid (salt)") at a concentration of 100 to 2,000 mg/L, a reductive decomposition step in which a reducing agent is added to the decontamination solution treated in the oxidative dissolution step in order to perform reductive decomposition of the permanganic acid (salt), and the reductive dissolution step conducted subsequent to the reductive decomposition step.

3. The chemical decontamination method according to claim 2, wherein, in the reductive decomposition step, ascorbic acid, etc. is added to the decontamination solution in an amount 1.0 to 2.0 times the amount equivalent to the permanganic acid (salt) in order to perform the reductive decomposition of the permanganic acid (salt).

4. The chemical decontamination method according claim 1, wherein, in the reductive dissolution step, the metal oxide is dissolved in a decontamination solution containing formic acid at a concentration of 1,000 to 10,000 mg/L, ascorbic acid, etc. at a concentration of 400 to 4,000 mg/L, and a corrosion inhibitor at a concentration of 100 to 500 mg/L.

5. The chemical decontamination method according to claim 1, wherein the metal-ion removal step includes a first cation-exchange treatment step in which the decontamination solution containing the metal ion, the decontamination solution being produced in the reductive dissolution step, is passed through a cation-exchange resin column in order to produce first cation-exchange treatment water containing an Fe ion at a concentration of 300 mg/L or less.

6. The chemical decontamination method according to claim 5, wherein, subsequent to the first cation-exchange treatment step, a formic acid oxidative decomposition step in which a corrosion inhibitor is added to the first cation-exchange treatment water at a concentration of 200 to 300 mg/L and hydrogen peroxide is subsequently added to the first cation-exchange treatment water in an amount 1 to 3 times the amount equivalent to the formic acid in order to decompose the formic acid using the Fe ion as a catalyst is conducted.

7. The chemical decontamination method according to claim 6, wherein the metal-ion removal step includes a second cation-exchange treatment step in which water treated in the formic acid oxidative decomposition step is irradiated with ultraviolet radiation and subsequently passed through a cation-exchange resin column in order to remove the metal ion.

8. The chemical decontamination method according to claim 7, wherein an ascorbic acid, etc. oxidative decomposition step in which a corrosion inhibitor is added to water treated in the second cation-exchange treatment step at a concentration of 200 to 300 mg/L, hydrogen peroxide is subsequently added to the treated water, and the treated water is then irradiated with ultraviolet radiation in order to perform oxidative decomposition of the ascorbic acid, etc. is conducted.

9. The chemical decontamination method according to claim 8, wherein water treated in the ascorbic acid, etc. oxidative decomposition step is passed through a mixed-bed resin column in order to produce treated water having an electric conductivity of 2 μS/cm or less.

* * * * *